US006634917B1

(12) United States Patent
Kling et al.

(10) Patent No.: US 6,634,917 B1
(45) Date of Patent: Oct. 21, 2003

(54) DISCHARGE LAMP WITH ELECTRODE FRAME

(75) Inventors: Rainer Kling, Dossenheim (DE); Reinhold Wittkoetter, Wermelskirchen (DE)

(73) Assignee: Patent treuhand-Gesellschaft fuer Elektrische Gluehlampen mbH, Munich (DE)

( * ) Notice: Subject to any disclaimer, the term of this patent is extended or adjusted under 35 U.S.C. 154(b) by 169 days.

(21) Appl. No.: 09/869,276

(22) PCT Filed: Oct. 6, 2000

(86) PCT No.: PCT/DE00/03515

§ 371 (c)(1),
(2), (4) Date: Jun. 26, 2001

(87) PCT Pub. No.: WO01/35436

PCT Pub. Date: May 17, 2001

(30) Foreign Application Priority Data

Nov. 5, 1999 (DE) ..... 199 53 531

(51) Int. Cl.[7] ..... H01J 9/32

(52) U.S. Cl. ..... 445/25; 445/23; 445/24; 445/26; 445/22

(58) Field of Search ..... 445/25, 22, 23, 445/24, 26, 27, 28, 39, 43, 44, 46; 313/17, 31, 344, 628

(56) References Cited

U.S. PATENT DOCUMENTS

| | | | | |
|---|---|---|---|---|
| 4,195,253 | A | * | 3/1980 | Drop et al. |
| 4,746,316 | A | * | 5/1988 | Sudo et al. |
| 5,133,682 | A | * | 7/1992 | Gilligan et al. |
| 5,386,170 | A | | 1/1995 | Kogelschatz |
| 6,048,241 | A | * | 4/2000 | Traksel et al. |
| 6,087,774 | A | * | 7/2000 | Nakayama et al. |

FOREIGN PATENT DOCUMENTS

| | | |
|---|---|---|
| DE | 196 36 965 | 3/1998 |
| WO | 94/23442 | 10/1994 |

* cited by examiner

*Primary Examiner*—Chau N. Nguyen
*Assistant Examiner*—Nguyen Ha
(74) *Attorney, Agent, or Firm*—Carlo S. Bessone

(57) ABSTRACT

The invention relates to a method for producing a discharge lamp, which is preferably designed for dielectric barrier discharges. The innovation is that a frame is used in order to set, and secure in its position, an electrode running at a distance from the vessel faces in the discharge vessel of the discharge lamp. This frame is simultaneously used as an exhaust tube.

18 Claims, 2 Drawing Sheets

DISCHARGE LAMP WITH ELECTRODE FRAME

TECHNICAL FIELD

The invention relates to a method for producing a discharge lamp having a discharge vessel filled with a discharge medium and having an electrode running at a distance from the vessel faces in the discharge vessel, wherein during the production of the discharge vessel, an exhaust tube through which the discharge vessel is evacuated and/or filled with the discharge medium, and which is subsequently sealed, is applied to the discharge vessel.

PRIOR ART

A small tube or the like, which projects through a wall of the discharge vessel, is customarily co-fused as an exhaust tube during the production of the discharge vessel. After the discharge vessel has then been sealed hermetically, apart from the exhaust tube, an evacuating pump is externally connected to the exhaust tube and the discharge vessel is evacuated to the desired reduced pressure. The discharge vessel is subsequently filled through the exhaust tube with the discharge medium, in general a gas or gas mixture. After the gas conditions in the discharge vessel have been adjusted suitably, the small tube forming the exhaust tube is fused off outside the discharge vessel, in general relatively close to the discharge vessel, in order to seal the discharge vessel in a completely vacuum-tight fashion. The exhaust tube is customarily applied to the discharge vessel in such a way that it does not project into the interior of the discharge vessel.

Discharge lamps with dielectric barrier discharge are a special type of discharge lamp. In this case, the electrode and/or a counter electrode or a plurality of counter electrodes are separated, by at least one dielectric, from the discharge in the interior of the discharge vessel. The invention pertains not exclusively, but preferably to such discharge lamps for dielectric barrier discharges.

In such discharge lamps, a voltage is applied between the electrode and a counter electrode, which is likewise located in the discharge vessel or on the discharge vessel, with the result that a discharge takes place, between the electrode and the counter electrode, in the discharge medium. Incoherent radiation is released during this discharge. Depending on the type of lamp design, and especially on the discharge medium, ultraviolet or infrared radiation or visible light is radiated. Such a lamp is described, for example, in DE 196 36 965 A1.

Distinction is made between discharge lamps operated in the so-called bipolar mode and in the so-called unipolar mode.

In the case of a unipolar discharge lamp, one of the two electrodes permanently forms the anode, and the other electrode forms the cathode. It is then sufficient to separate the anode from the discharge by the dielectric. The vessel wall can also be used as the dielectric for this. In this case, only the cathode is located in the discharge vessel, while the anode or anodes are externally applied to the vessel wall. These may involve, for example, strips of a gold or platinum paste, which are printed directly onto the vessel wall.

In the case of the bipolar discharge lamp, the two electrodes are not distinct from one another, and both are screened by a dielectric. By corresponding voltage alternation, first one electrode and then the other electrode forms the anode. Preferably, the discharge lamps are supplied with an in principle unrestricted sequence of extremely short voltage pulses at high repeat frequency. In this context, reference is made to WO94/23442.

It is clear that a successful and efficient discharge depends on the distance from the electrode to the counter electrodes. This is particularly relevant in the case of discharge lamps with a dielectric barrier discharge, for which the efficiency depends strongly on the accurate geometry of the discharge regions in the discharge vessel. Because of this dependency on the electrode geometry, even minor changes in the position of an electrode would lead to a large efficiency reduction of the discharge lamp.

DESCRIPTION OF THE INVENTION

It is therefore an object of the present invention to provide a cost-efficient and simple method for producing a discharge lamp, in which accurate seating of the electrode during production and in subsequent use is guaranteed.

This object is achieved in that a frame made of non-conductive material, which fixes the electrode at a predetermined position in the discharge vessel, is arranged in the discharge vessel, and this frame or a part of this frame is designed and used as an exhaust tube or part of an exhaust tube.

According to the invention, the exhaust tube which is in any case needed for the production of a discharge lamp is simultaneously used to act as a frame or part of a frame. Reliable positioning of the electrode during production and in subsequent use is thereby possible, and additional method steps can be minimized or additional method steps can even be avoided. In other words, the cost of production is not increased by the method according to the invention, or is only increased insignificantly.

The frame, or the part of the frame used as an exhaust tube, can in principle have any desired shape that is suitable for fixing or supporting the electrode correspondingly. For use as an exhaust tube, it is merely necessary for the corresponding part of the frame to have an opening passing from the outside inward into the discharge vessel, and a possibility for hermetic connection of the evacuating and filling system.

In a preferred embodiment of the method according to the invention, the part of the frame used as an exhaust tube is designed in the form of a tube, which projects with one end through a wall of the discharge vessel into the discharge vessel. For that purpose, it is basically only necessary to lengthen the customary exhaust tube used hitherto.

This method is advantageous especially when the electrode has an elongate shape extending substantially in a main extension direction. The frame can be designed so that it has an elongate support element which runs in the main extension direction of the electrode and supports the electrode over at least one sub-region, the support element and the electrode being aligned coaxially or parallel with one another.

In this case, the aforementioned inwardly lengthened exhaust tube can be used as a support element or support tube. It is consequently possible, by corresponding arrangement of the tube projecting into the discharge vessel with respect to the electrode, to guarantee simple and reliable support of the electrode.

Of course, the support element may also be formed in a different way, for example an elongate plate-like support element or the like, which is provided with a corresponding tube part or has a corresponding bore. Likewise, the electrode may also have any desired shape. For instance, it may comprise lengthwise strips, a wave shape, for example in a sine shape, zigzagged electrodes, a coil or the like.

In a particularly preferred embodiment, the electrode runs in a coil shape around the support element at least over a sub-region of the lengthwise extent. The advantages of this coil electrode, and of the resulting structure of the discharges, are presented in the previously cited DE 196 36 965 A1.

The electrode can be applied to the frame, or to an element of the frame, in the form of a correspondingly structured conductive coating, for example of gold or platinum paste. For instance, a coil-shaped inner electrode can be applied in this way to a support rod or support tube running in the extension direction of the electrode. Electrodes in the form of strips, waves or zigzags can, for example, be applied to an elongate, plate-shaped support element.

In a particularly preferred embodiment, the discharge vessel is cylindrical with an inner electrode extending along the cylinder axis and with a support element. It is consequently a discharge lamp with a central or concentric middle electrode. It is suitable in this case for a plurality of strip-shaped counter electrodes, running parallel with the cylinder axis, to be applied to the vessel walls. The entire discharge space can be used effectively in this way, the geometrical arrangement needed for this being relatively simple to create. The problem, which then arises, of an exact central or concentric position of the middle electrode during production and constant operation is solved by the invention.

The support element, for example in the form of the support tube used as an exhaust tube, advantageously projects into the discharge vessel from an end side opposite a lamp cap, and is fastened to the corresponding end face. Especially in the case of fairly long discharge vessels, however, capping on both sides may also be advantageous. The exhaust-tube side is then also covered by a cap.

Of course, the support element or the tube may also be long enough for the electrode to be supported over the entire length.

Preferably, one or more openings which pass through the tube wall, and are located inside the discharge vessel, are made in the support tube along the lengthwise extent. Through these openings, better and more effective pumping and filling of the discharge vessel is possible.

In a preferred embodiment, the discharge vessel is sealed on one side by pinching. In this case, a metal foil is co-embedded and acts as an electrical feed-through for the inner electrode. The latter is fastened, for example soldered, to the metal foil and is partly co-pinched with one end, so that the electrode is held on one side by the pinch seal.

In order to prevent displacement of the electrode in the lengthwise direction of the support element, the latter advantageously has a retaining projection extending transversely with respect to the lengthwise direction of the support element, or with a retaining recess. The retaining projection may comprise corresponding bumps, lugs, spikes etc., and the retaining recess may be a groove or the like. Using such bumps or lugs, a wire coil which runs around a support tube or a support rod may, for example, be secured very well against lengthwise displacement.

In an alternative embodiment of the frame, a spacer is located between the electrode and a vessel wall, transversely with respect to the main extension direction of the electrode. Such a spacer may be a hook-like element, a small tube or a pin which is fastened to a vessel wall and holds the electrode in position. A plurality of such spacers are preferably used along the main extension direction of the electrode. In order to permit the function as an exhaust tube, of course, a corresponding bore must be made in at least one of the spacers.

Of course, it is also possible to use a, for example, tubular support element and additionally spacers running transversely with respect thereto. This is suitable, in particular, for the production of very long lamps.

In a preferred embodiment, this additional spacer for fixing the support element is a retaining disk, which is arranged transversely with respect to the main extension direction of the electrode, which extends between the vessel faces, and through which the electrode with the insertion element runs at a predetermined position. Such a retaining disk guarantees reliable positioning in every direction.

DESCRIPTION OF THE DRAWINGS

The invention will be explained in more detail below, with reference to the appended drawings, with the aid of exemplary embodiments. The features that are presented can be essential to the invention not only in the stated combinations, but also individually or in other combinations.

FIG. 1 shows a first exemplary embodiment of a discharge lamp according to the invention. This discharge lamp 1 has a discharge vessel 2 made of quartz glass, which is mounted on one side in a cap 5.

Figure 1:
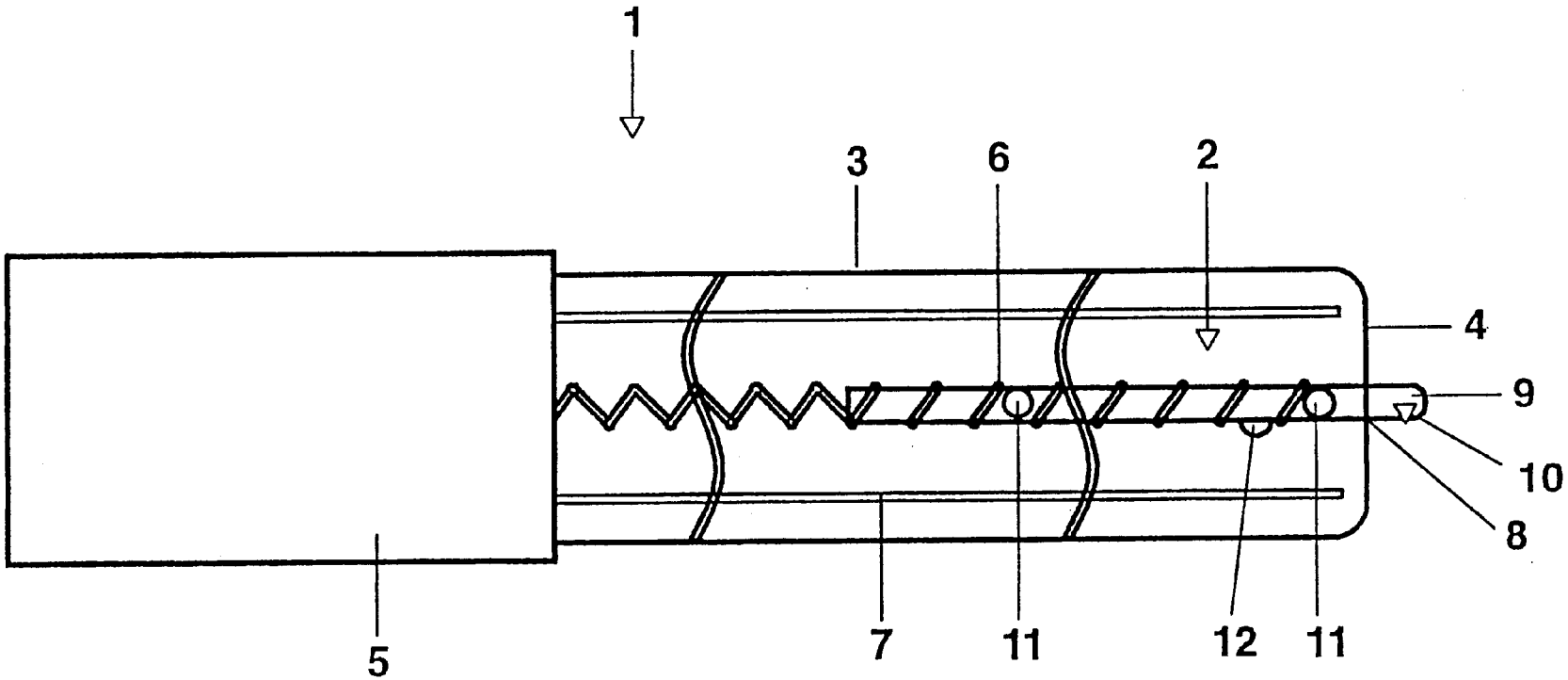
FIG. 1 represents a schematic side view of a discharge lamp with a cylindrical discharge vessel and an axial central electrode, which is held by a support tube.

The interior of the discharge vessel 2 is filled with a discharge medium. In the present exemplary embodiment, the lamp is an excimer discharge lamp which is filled with xenon. With such an excimer discharge lamp, VUV radiation is produced with high efficiency, this being used industrially, for example, for cleaning wafers, for ozone production or for water pollution control.

Inside the cylindrical discharge device, the lamp has a central coil-shaped electrode 6. This is the cathode, which is at a negative high voltage. On the outside of the discharge vessel 2, there are a plurality of strip-shaped electrodes 7 running parallel with the cylinder axis. These are the anodes. They are separated from the discharge space by the wall 3 of the discharge vessel 2. The lamp is hence designed for dielectric barrier discharges.

As a frame 10, the lamp 1 has an axial support tube 9, which projects from the end wall 4 opposite the lamp cap 5 into the interior of the discharge vessel 2. The coil-shaped electrode 6 is partially fed around this support tube 9. In order to prevent displacement of the coil-shaped electrode 6 in the axial direction, a retaining projection 12 in the form of a bump is formed on the support tube 9.

The frame consists of a non-conductive material, for example glass, quartz glass or ceramic.

The discharge vessel 2 is firstly sealed on the end wall 4 opposite the cap region, the support tube 9 being hermetically enclosed and fixed in a central opening 8 in the end wall 4. To form the end wall 4 with the enclosed support tube 9, the open cylindrical vessel is heated and the support tube 9 is held by suitable aids, while the cylinder wall contracts inward under the effect of heat. This sealing may, however, also be carried out by pinching.

The coil 6 is then co-pinched (not shown) inside the cap region with vacuum-tight sealing of the cylindrical discharge vessel 2. In the region of the opposite end wall 4, it is held by the support tube 9.

To apply the coil 6 to the support tube 9, or to introduce the support tube 9 into the coil 6, the coil 6 is screwed onto the support tube 9, with the retaining projection 12 moving between the coil turns.

The support tube 9 is simultaneously used as an exhaust tube, by pumping out the discharge vessel 2 through the support tube 9 and filling it with gas through the tube 9. In the case of fairly long discharge lamps, it is expedient to arrange at least one, preferably a plurality of openings 11 along the support tube 9 in the tube side faces, in order to permit fast and effective pumping of the discharge vessel.

Of course, not only can the support tube 9 be held in the end wall 4, but it can also extend lengthwise through the entire discharge vessel 2 as far as the cap region 5, and can also optionally be fastened in the end wall in the cap region 5, for example pressed in together at the same time during production. The coil 6 may, as in the exemplary embodiment shown, be a wire coil. Alternatively, however, the coil may also be applied to the support tube 9 by means of a conductive paste, for example gold or platinum paste or the like. In the case of a continuous support tube 9, which is co-pinched in the cap region, it is advantageous if the electrode 6 in the pinch region is formed by a wire or a metal foil and, inside the discharge vessel 2 above the pinch site, the electrode then consists of the structured, conductive coating on the support tube 9, the lower coil region consisting of wire or the metal foil and the upper coil region being correspondingly connected to one another.

Because of the frame according to the invention, it is possible to produce lamps according to the exemplary embodiment as shown by FIG. 1 in almost any length. At present, without such a frame, lengths of 20 cm can be produced, without reliable seating of the electrode 6 being at risk. On a trial basis, lamps with a length of more than 85 cm are currently being produced in the manner according to the invention.

FIGS. 2 to 5 respectively show alternative exemplary embodiments of a frame.

In the exemplary embodiment shown, the support tube 9 is relatively long. In another exemplary embodiment (not shown), the support tube is only approximately 2 cm long and supports an approximately 12 cm long coil only in the end region.

Figure 2:
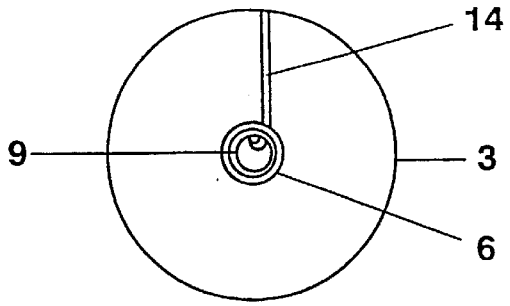
FIG. 2 represents a cross section through a discharge vessel according to FIG. 1, with a support tube and an additional frame in the form of a spacer.

The exemplary embodiment represented in FIG. 2 involves a hook-shaped spacer 14 which is fastened, for example integrally fused, at one end to the vessel wall 3, and additionally fixes the support tube 9 transversely with respect to the extension direction. In order to hold the support tube 9 with the coil 6 reliably in this way over a fairly long distance, a plurality of such spacers 14 may be arranged along the lengthwise extension direction, these also advantageously running radially outward in different directions. A favorable distance between such spacer hooks 14 is approximately 15 cm.

Figure 3:
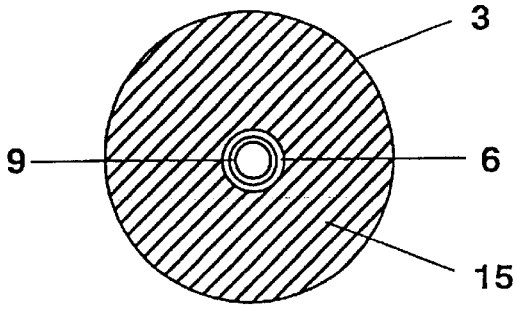
FIG. 3 represents a cross section through a discharge vessel according to FIG. 1, with a support tube and an alternative additional frame in the form of a retaining disk.

FIG. 3 shows, as a spacer, a continuous retaining disk 15 through which the support tube 9 with the coil 6 runs in the middle. This retaining disk 15 additionally supports the support tube 9 with the coil 6 on all sides relative to the vessel faces 3.

Figure 4:
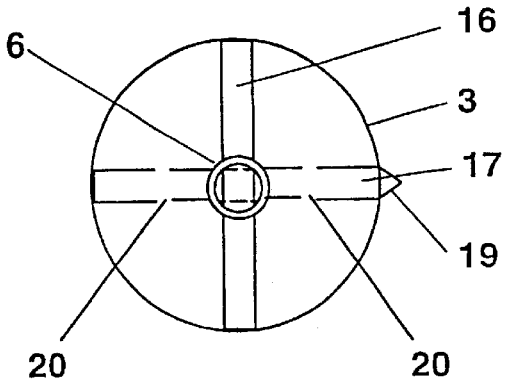
FIG. 4 represents a cross section through a discharge vessel according to FIG. 1, with an alternative frame comprising a plurality of retaining rods, which run transversely between the walls of the discharge vessel and one of which is used as an exhaust tube.

FIG. 4 shows a frame in the form of two retaining rods 16, 17 which run successively in the lengthwise direction of the coil 6 and respectively extend transversely through the discharge vessel 3 from one face side to the other. These retaining rods are fastened, for example integrally fused, to the wall 3 on at least one side. At least one of these retaining rods 16, 17 is designed as a hollow exhaust tube 17, which protrudes from the discharge vessel 2 via a section 19 at one site, and has at least one, preferably a plurality of openings 20 in the discharge vessel 2. In this version as well, it is expedient if a plurality of such rods 16, 17 are used successively in the lengthwise extent of the coil 6.

Figure 5:
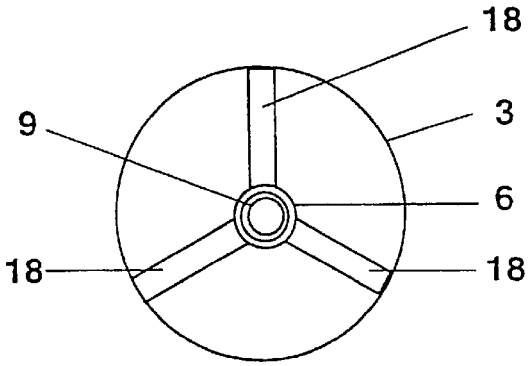
FIG. 5 represents a cross section through a discharge vessel according to FIG. 1, with an axially running support tube and a plurality of radially running transverse supports.

In the exemplary embodiment according to FIG. 5, an axially running support tube 9 is again used. This axially running support tube 9 is supported by a plurality of radially running transverse supports 18, which extend between the support tube 9 and the side wall 3 of the discharge vessel 2.

In another exemplary embodiment (not shown), the axially running support tube runs not inside the coil 6 but outside the coil 6. The inner coil-shaped electrode 6 is hence also separated from the discharge space by a dielectric, i.e. the wall of the support tube. Such a lamp is suitable for bipolar operation. Another alternative is to surround the electrode completely with dielectric material, for example to fuse the electrode into dielectric material. The electrode can again have any desired shape here. In this case, the electrode is quasi-integrated into the frame.

What is claimed is:

1. A method for producing a discharge lamp (1) having a discharge vessel (2) filled with a discharge medium and having an electrode (6) running at a distance from the vessel faces (3) in the discharge vessel (2), wherein during the production of the discharge vessel (2), an exhaust tube through which the discharge vessel (2) is evacuated and/or filled with the discharge medium, and which is subsequently sealed hermetically, is applied to the discharge vessel (2), characterized in that a frame (10, 14–18) made of non-conductive material, which fixes the electrode (6) at a predetermined position in the discharge vessel (2), is arranged in the discharge vessel (2), and this frame (10, 14–18) or a part of this frame (10, 14–18) is designed and used as an exhaust tube or part of an exhaust tube.

2. The method as claimed in claim 1, characterized in that the part of the frame (10) used as an exhaust tube is designed in the form of a tube (9), which projects with one end through a wall (4) of the discharge vessel (2) into the discharge vessel (2).

3. The method as claimed in claim 1, characterized in that an opening (11) passing through the tube wall is made in the walls of the tube (9) along its lengthwise extent in the discharge vessel (2).

4. The method as claimed in claim 1, characterized in that the electrode (6) has an elongate shape extending substantially in a main extension direction.

5. The method as claimed in claim 2, characterized in that the frame (10) has an elongate support element (10) which runs in the main extension direction of the electrode (6) and supports the electrode (6) over at least one sub-region.

6. The method as claimed in claim 5, characterized in that the support element (10) is designed as a support tube (9) which is used as an exhaust tube.

7. The method as claimed in claim 5, characterized in that at least one of the electrode (6) and the support element (10) are arranged in such a way that the electrode (6) runs in a coil shape around the support element (10) at least over a sub-region of its lengthwise extent.

8. The method as claimed in claim 5, characterized in that the discharge vessel (2) is cylindrical and at least one of the electrode (6) and the support element (10) are aligned along the cylinder axis.

9. The method as claimed in claim 5, characterized in that the support element (10) is fed into the discharge vessel (2) from an end side opposite a lamp cap (5), and is fastened in or to the end face (4).

10. The method as claimed in claim 5, characterized in that the support element (10) is provided with a retaining projection (12) extending transversely with respect to the lengthwise direction of the support element, or with a retaining recess.

11. The method as claimed in claim 5, characterized in that a spacer (14, 15), extending transversely with respect to the main extension direction, is arranged as the frame or part of the frame between the electrode (6) and/or a support element (9, 10) and a vessel wall (3).

12. The method as claimed in claim 11, characterized in that a retaining disk (15), which is arranged transversely with respect to the main extension direction of the electrode (6), which extends between the vessel faces (3), and through which the electrode (6) and the support element (9, 10) run at a predetermined position, is used as a spacer (15).

13. The method as claimed in claim 1, characterized in that the electrode is applied to the frame in the form of a structured conductive coating.

14. The method as claimed in claim 1, characterized in that the electrode is arranged at least partially inside at least a part of the frame.

15. The method as claimed in claim 12, characterized in that the electrode is arranged at least partially inside a support tube.

16. The method as claimed in claim 13, characterized in that the electrode is arranged, at least over a sub-region of its lamp extension, running in a coil shape inside the support tube.

17. The method as claimed in claim 1, characterized in that the frame is produced from glass, quartz glass or ceramic.

18. The method as claimed in claim 1, characterized in that the discharge lamp (1) is designed for dielectric barrier discharges.

* * * * *